US008515116B2

(12) United States Patent
Lee

(10) Patent No.: US 8,515,116 B2
(45) Date of Patent: Aug. 20, 2013

(54) HEADPHONES WITH WAVEGUIDER

(75) Inventor: Jong-Bae Lee, Seoul (KR)

(73) Assignee: Cresyn Co., Ltd., Seoul (KR)

( * ) Notice: Subject to any disclaimer, the term of this patent is extended or adjusted under 35 U.S.C. 154(b) by 132 days.

(21) Appl. No.: 12/918,316

(22) PCT Filed: Mar. 21, 2008

(86) PCT No.: PCT/KR2008/001598
§ 371 (c)(1),
(2), (4) Date: Nov. 18, 2010

(87) PCT Pub. No.: WO2009/104833
PCT Pub. Date: Aug. 27, 2009

(65) Prior Publication Data

US 2011/0051975 A1 Mar. 3, 2011

(30) Foreign Application Priority Data

Feb. 20, 2008 (KR) ..... 10-2008-0015560

(51) Int. Cl.
*H04R 25/00* (2006.01)

(52) U.S. Cl.
USPC ..... 381/380; 381/373; 381/338

(58) Field of Classification Search
USPC ..... 381/370, 373, 372, 380
See application file for complete search history.

(56) References Cited

U.S. PATENT DOCUMENTS 4,005,278 A * 1/1977 Gorike ..... 381/373
7,391,878 B2 * 6/2008 Liao ..... 381/370
8,139,806 B2 * 3/2012 Hosaka et al. ..... 381/373
2007/0154050 A1 7/2007 Kim
2008/0013773 A1 * 1/2008 Yang ..... 381/379

FOREIGN PATENT DOCUMENTS

EP 1879424 A2 1/2008
KR 200343225 Y1 3/2004
WO WO2004-091253 A1 10/2004

OTHER PUBLICATIONS

International Search Report, mailing date Sep. 26, 2008, for corresponding International Application No. PCT/KR2008/001598.

* cited by examiner

*Primary Examiner* — Mohammad Islam
*Assistant Examiner* — Phylesha Dabney
(74) *Attorney, Agent, or Firm* — Intellectual Property Law Group LLP

(57) ABSTRACT

A headphone having a waveguider is disclosed which can control the amount of air flowing into the headphone. The headphone includes: a housing having a receiving space therein and at least one or more air inlets at one side thereof, in which the housing is opened at the front side thereof a speaker placed in the receiving space, for generating audio sounds according to input electrical signals; a cover for closing the front side of the housing, the cover forming a plurality of audio sound through-holes through which the audio sounds from the speaker pass; and a waveguider slidably and rotatably installed to the housing. The waveguider includes a kernel part protrudently formed, for guiding the audio sounds passing through the cover to the inner ear, and an opening/closing part for closing at least one or more air inlets according to a rotation angle thereof to control the amount of air that instantly flows into the housing. The waveguider is slidably and rotatably moved to partially or completely close a plurality of air inlets formed in the housing. Therefore, the amount of air flowing into the housing can be controlled and thus the intensity of the bass can be adjusted.

2 Claims, 3 Drawing Sheets

HEADPHONES WITH WAVEGUIDER

TECHNICAL FIELD

The present invention relates to headphones, and more particularly, to headphones that can control the amount of air that flows into the headphones.

BACKGROUND ART

Headphones are widely used to closely couple the sounds they produce, such as music, etc., to the listener's ear such that the sounds are relatively free from interference from other sounds present in the listener's environment. Headphones can be classified into open-type headphones and closed-type headphones in accordance with the classification methods.

Open-type headphones can minimize dull sounds because they are configured in such a way that sounds from a diaphragm of a speaker are not confined but are able to spread. On the contrary, closed-type headphones generate dull sounds.

The closed-type headphones are tightly fitted into the ear canal to minimize noise from the outside. Therefore, the closed-type headphones are free from interference from the outside noise, so the listener can listen to audio sounds from the diaphragm of the speaker, such as music, in a noisy environment. Also, audio sounds from the diaphragm of the speaker do not escape the listener's environment to be overheard by, or interfere with, the environment of bystanders.

However, when the listener wears the closed-type headphones for a relatively long period of time, the pads contacting the ears make the listener feel uncomfortable in comparison with the open-type headphones. Furthermore, since the air pressure of audio sounds from the diaphragm directly impacts the eardrum, the eardrum can be injured.

Meanwhile, to utilize the advantages of both the open-type headphones and the closed-type headphones, headphones have been proposed which are configured in such a way that a waveguider is mounted on the open-type headphones, respectively. The headphones having a waveguider will be described in the preferred embodiments of the present invention.

The conventional headphones form air inlets into which air instantly flows as the diaphragm of the speaker is vibrated. The technique that controls the amount of air flowing into the air inlets of the headphones was disclosed in Korean Patent Nos. 0767390 and 0767391, which are related to the headphones having an equalizer.

The conventional headphones having an equalizer close or open air outlets formed on the back side of their respective housings to boost bass and treble. However, since the closing process or the opening process of the air outlets is performed within the headphones, a listener cannot monitor by how much the air outlets are closed or opened and thus the fidelity of the headphones is reduced.

DISCLOSURE OF INVENTION

Technical Problem

The present invention solves the above problems, and provides headphones that can control the amount of air flowing into the headphones using a waveguider.

Technical Solution

In accordance with an exemplary embodiment of the present invention, the present invention provides a headphone including: a housing having a receiving space therein and at least one or more air inlets at one side thereof, the housing being opened at the front side thereof; a speaker placed in the receiving space, for generating audio sounds according to input electrical signals; a cover for closing the front side of the housing, the cover forming a plurality of audio sound through-holes through which the audio sounds from the speaker pass; and a waveguider slidably and rotatably installed to the housing.

Here, the waveguider includes: a kernel part protrudently formed, for guiding the audio sounds passing through the cover to the inner ear; and an opening/closing part for closing at least one or more air inlets according to a rotation angle thereof to control the amount of air that instantly flows into the housing.

Preferably, the waveguider is detachably installed to the housing.

In accordance with another exemplary embodiment of the present invention, the present invention provides a headphone including: a housing having a receiving space therein and at least one or more air inlets at one side thereof, the hosing being opened at the front side thereof; a speaker placed in the receiving space, for generating audio sounds according to input electrical signals; a cover for closing the front side of the housing, the cover forming a plurality of audio sound through holes through which the audio sounds from the speaker pass; and an air inflow controller slidably and rotatably installed to the housing.

Here, the air controller includes: an opening/closing part for closing at least one or more air inlets according to a rotation angle thereof to control the amount of air that instantly flows into the housing.

Advantageous Effects

As described above, the present invention provides the headphones with a waveguider, which have the following effects:

First, the waveguider of the headphones is slidably and rotatably moved on the housing to partially or completely close a plurality of air inlets formed in the housing. When the waveguider is operated, the amount of air flowing into the housing can be controlled and thus bass can be also adjusted. Also, the listener can check how the amount of air flowing into the housing is controlled and how bass is controlled.

Second, the waveguider is designed to be detachably coupled to the housing. Therefore, only one type of headphones can be used as both closed-type headphones and open-type headphones depending on whether the waveguider is coupled to the housing of the headphones.

BRIEF DESCRIPTION OF THE DRAWINGS

The features and advantages of the present invention will be more apparent from the following detailed description in conjunction with the accompanying drawings, in which.

BRIEF DESCRIPTION OF SYMBOLS IN THE DRAWINGS

Figure 1:
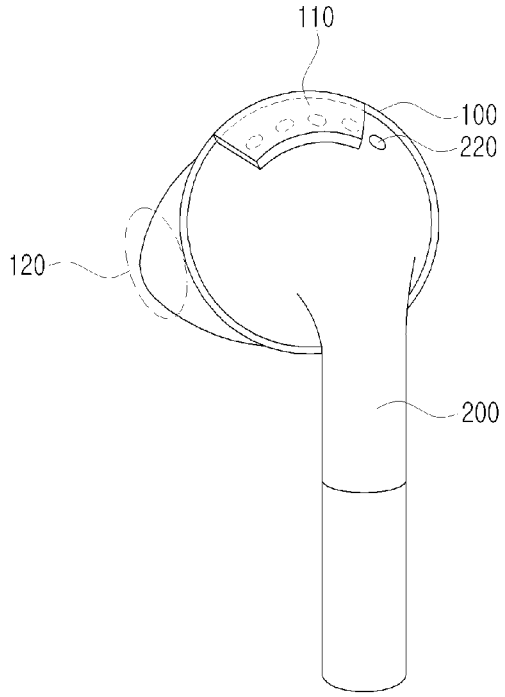
FIG. 1 is a perspective view of a headphone whose housing having air inlets, according to an embodiment of the present invention, in which the air inlets are partially closed by an opening/closing part of a waveguider mounted on the housing

100: waveguider
110: opening/closing part
120: kernel part
130: open hole
200: housing
210: cover
220: air inlet
300: air inflow controller

BEST MODE FOR CARRYING OUT THE INVENTION

Hereinafter, embodiments of the present invention are described in detail with reference to the accompanying drawings. The same reference numbers are used throughout the drawings to refer to the same or similar parts. Detailed descriptions of well-known functions and structures incorporated herein may be omitted to avoid obscuring the subject matter of the present invention.

Figure 2:
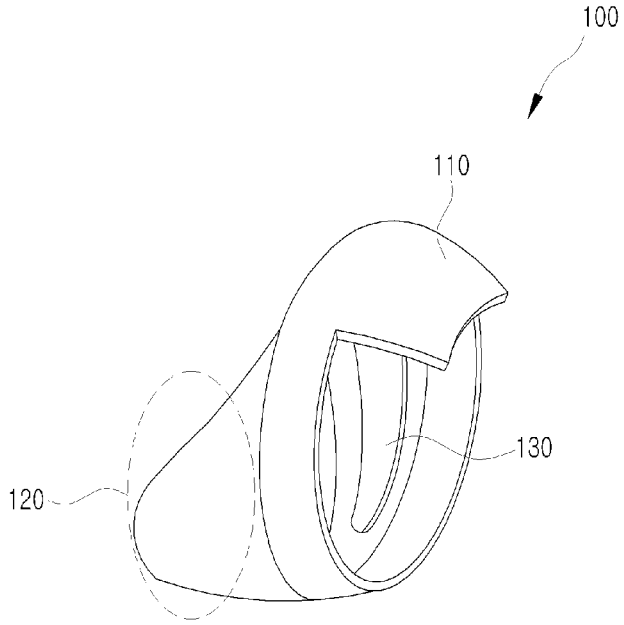
FIG. 2 is a perspective view of the waveguider of FIG. 1.
Figure 3:
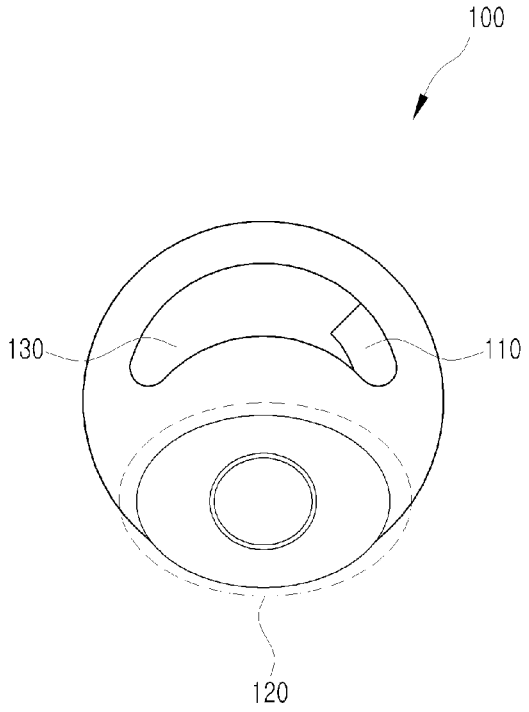
FIG. 3 is a side view of the waveguider of FIG. 1.
Figure 4:
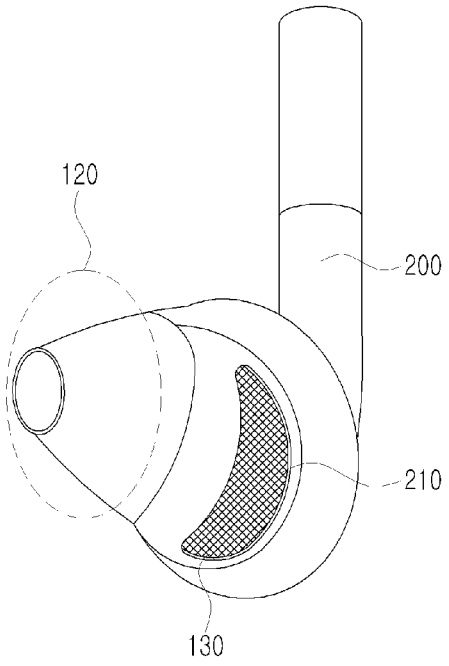
FIG. 4 is a perspective view of the headphone of FIG. 1, illustrating that the waveguider is mounted on the housing and a cover is exposed through an open hole.

FIG. 1 is a perspective view of a headphone whose housing having air inlets, according to an embodiment of the present invention, in which the air inlets are partially closed by an opening/closing part of a waveguider mounted on the housing. FIG. 2 is a perspective view of the waveguider of FIG. 1. FIG. 3 is a side view of the waveguider of FIG. 1. FIG. 4 is a perspective view of the headphone of FIG. 1, illustrating that the waveguider is mounted on the housing and a cover is exposed through an open hole.

The headphone of the present invention include a housing 200, a speaker (not shown), a cover 210, and a waveguider 100.

The housing 200 includes a receiving space (not shown) therein and forms a plurality of air inlets 220 thereon. In particular, the housing 200 is open at its front side and forms five air inlets 220 on one side.

The receiving space receives the speaker.

The air inlets 220 are formed on the side of the housing 200, so that air necessary for vibration of the diaphragm of the speaker can smoothly flow into the housing 200. The five air inlets 220 are aligned in line along the edge of the housing 200. In the present embodiment, the number of the air inlets 220 is five, however, it should be understood that the number of the air inlets 220 may be implemented by at least one or more, aligned in line along the edge of the housing 200. When only one air inlet 220 is formed on the housing, it is shaped as a long through-hole expanding along the edge of the housing 200. In addition, it should be understood that each of the air inlets 220 can be shaped in any form.

The speaker is placed in the receiving space. The speaker converts input electrical signals to audio sounds to be output.

The cover 210 is made of a wire mesh material or a plastic material having a plurality of small audio sound through-holes through which the audio sounds from the speaker pass.

The waveguider 100 includes an opening/closing part 110, a kernel part 120, and an open hole 130. The waveguider 100 is fitted into the housing 200, covering the cover 210. The waveguider 100 can be slidably and rotatably moved at the edge of the housing 200. Since the waveguider 100 directly contacts a listener's ear, it is made of rubber or silicon and thus provides enhanced wearing comfort. It should be understood that the waveguider 100 may be implemented by any other materials.

The opening/closing part 110 is formed at one side of the waveguider 100. The opening/closing part 110 partially or completely closes the plurality of air inlets 220, according to the rotation angle of the waveguider 100 mounted on the housing 200, so that the air flowing into the housing 200 can be partially or completely blocked. That is, the amount of air instantly flowing into the air inlets 220 can be controlled.

The kernel part 120 is inserted into the ear canal while the waveguider 100 is fitted into the housing 200. The kernel part 120 minimizes the audio sounds from the speaker to prevent these sounds from escaping to the listener's outside environment and instead the audio sounds can be directly transmitted to the eardrum. The amount of sound directly transmitted can be controlled depending on the shape of the audio sound through-hole. The kernel part 120 is formed at one side of the waveguider 100. The kernel part 120 is protruded to be inserted into the ear canal and curved to fit the shape of the ear.

The open hole 130 is formed on the opposite side of the kernel part 120. When the waveguider 100 is installed to the housing 200, the open hole 130 serves to directly transmit the audio sounds passing through the audio sound through-hole of the cover 210 to the inner ear, bypassing the waveguider 100, as a general open-type headphone. The open hole 130 is shaped as shown in FIG. 2, however, it should be understood that the open hole 130 can be implemented by any other shape and any number of holes.

The following is a description of the headphone with the waveguider 100 configured above.

When listeners wearing headphones walk on the street, they can hardly hear bass sounds because these sounds are mixed in with peripheral sounds. In order to solve this problem, listeners tend to use closed-type headphones capable of blocking external noise. However, since such closed-type headphones are tightly fitted to the ear canal, bass is boosted. Since the bass is boosted, the audio sound characteristics are deteriorated. Also, since the ear canal is tightly sealed, the listener may feel uncomfortable when wearing closed-type headphones.

However, the waveguider 100 of the headphones according to the present invention, is installed to the housing 200 and the cover 210, may be rotated on the edge of the housing 200. At least one or more air inlets 220 are formed on the housing 200, which is at the rear side of the cover 210. When the air inlets 220 are formed in plural, they may be aligned in line along the edge of the housing 200. When the number of air inlet 220 is one, it may be formed as a long opening along the edge of the housing 200. The waveguider 100 is slidably and rotatably moved so that the opening/closing part 110 can partially or completely close one air inlet 220 or partially or completely close a plurality of air inlets 220, thereby controlling the amount of air that flows into the housing 200.

When the opening/closing part 110 closes most of the air inlets 220, the amount of air that flows into the housing 200 is reduced, and thus the sealing effect occurring in closed-type headphones, which reproduces an excessive bass sound, can be minimized. Also, when the opening/closing part 110 does not close the air inlets or partially closes the air inlets so that most of the air inlets 220 can be opened, the amount of air that flows into the housing 200 is increased, thereby strongly adjusting a bass sound. Here, the number of air inlets 220 is plural to easily adjust the amount of bass according to the user's requirements.

The open hole 130 is formed in the waveguider 100. The amount of sound input to the kernel part 120, inserted into the ear canal, can be adjusted according to how the open hole 130 is designed. Also, the open hole 130 can assist in reducing the deafening or unpleasant feeling caused by the complete sealing in a closed-type headphone. Therefore, when the open hole 130 is formed in the waveguider 100, part of the air transmitted to the eardrum can be indirectly transmitted to the eardrum, as in open-type headphones. Therefore, even if a listener wears the closed-type headphones for a relatively long period of time, the listener almost completely avoids any unpleasant feelings caused by the complete sealing of the closed-type headphone.

The waveguider 100 is configured in such a way that it can be detachably installed to the housing 200. That is, the listener can use the headphones as closed-type headphones when the waveguider 100 is installed to the housing or as open-type headphones when the waveguider 100 is removed from the housing 200.

Figure 5:
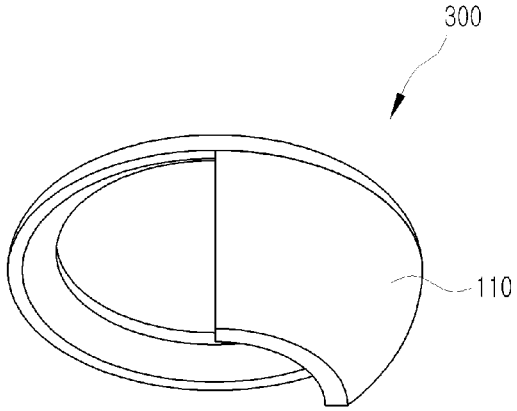
FIG. 5 is a perspective view of an air inflow controller having an opening/closing part, adapted to a headphone having a waveguider, according to another embodiment of the present invention.

FIG. 5 is a perspective view of an air inflow controller having an opening/closing part, adapted to a headphone having a waveguider according to another embodiment of the present invention.

The air inflow controller 300 of FIG. 5 is modified from the embodiment as shown in FIG. 1 to FIG. 4, in such a way that the kernel part 120 is removed from the waveguider 100 and instead an opening/closing 110 is included to control the amount of air that flows into the air inlets formed in the housing. It is preferable that the open hole 130 is formed in the waveguider 100 so that the audio sound through-holes of the cover 210 can all be exposed.

The air inflow controller 300 is rotatably installed to the housing 200. The air inlets 220 can be partially or completely closed to control the amount of air that flows into the air inlets 220 according to the rotation angle of the air inflow controller 300.

The present invention can be implemented, in yet another embodiment, in such a way that the waveguider 100 in the embodiment of FIGS. 1 to 4 or the air inflow controller in another embodiment of FIG. 5 is not used, but instead an opening/closing part 110 is formed at one side of the cover 210. Like the air inflow controller 300, the cover 210 is configured to be rotatably moved. Therefore, the listener partially or completely closes the air inlets according to the listener's desire to control the amount of air that flows into the housing.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

The present invention can be properly applied to the field of Headphone.

The invention claimed is:

1. A headphone comprising:

a housing having a receiving space therein and at least one or more air inlets at one side thereof, the housing being opened at the front side thereof, a speaker placed in the receiving space, for generating audio sounds according to input electrical signals, a cover for closing the front side of the housing, the cover forming a plurality of audio sound through-holes through which the audio sounds from the speaker pass and a waveguider slidably and rotatably installed to the housing, surrounding an outermost perimeter of the housing, wherein the waveguider comprises:

a kernel part protrudently formed, for guiding the audio sounds passing through the cover to the inner ear and an opening/closing part for closing at least one or more air inlets according to a rotation angle thereof to control the amount of air that instantly flows into the housing, the opening/closing part rotatable around the housing relative to the kernel part of the waveguider.

2. The headphone according to claim 1, wherein the waveguider is detachably installed to the housing.

* * * * *